US008336993B2

(12) United States Patent
Chen et al.

(10) Patent No.: US 8,336,993 B2
(45) Date of Patent: Dec. 25, 2012

(54) PRINT HEAD WITH SECURITY ASSEMBLY

(75) Inventors: Chen-Hsing Chen, New Taipei (TW); Chang-Lun Tai, New Taipei (TW); Hsing-Yi Hu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 27 days.

(21) Appl. No.: 13/185,300

(22) Filed: Jul. 18, 2011

(65) Prior Publication Data

US 2012/0075384 A1 Mar. 29, 2012

(30) Foreign Application Priority Data

Sep. 23, 2010 (TW) ..... 99132138 A

(51) Int. Cl.
*B41J 2/135* (2006.01)

(52) U.S. Cl. ..... 347/44; 347/47; 347/67

(58) Field of Classification Search ..... 347/20, 347/40, 42, 44, 47, 49, 59, 63–67, 71
See application file for complete search history.

(56) References Cited

U.S. PATENT DOCUMENTS 4,728,392 A * 3/1988 Miura et al. ..... 216/27

* cited by examiner

*Primary Examiner* — Thinh Nguyen
(74) *Attorney, Agent, or Firm* — Altis Law Group, Inc.

(57) ABSTRACT

A print head includes a nozzle plate, a fixing plate fixed to the nozzle plate, an oscillation sheet, and a security assembly. The fixing plate defines a receiving groove. The oscillation sheet is fixed between the fixing plate and the nozzle plate and covers the receiving groove. The security assembly includes a fixing component, an elastic component, a fixing element, an anti-detachable component, and a pointed tip extending from a distal end of the anti-detachable component. The security assembly is fixed to the fixing plate, the elastic component and the anti-detachable component are received in the receiving groove with the pointed tip pointed towards the oscillation sheet. A first end of the compressed elastic component resists against the fixing component and a second end of the elastic component resists the anti-detachable component.

19 Claims, 4 Drawing Sheets

PRINT HEAD WITH SECURITY ASSEMBLY

BACKGROUND

1. Technical Field

The present disclosure relates to printers, particularly to a print head with a security assembly for use in a printer.

2. Description of Related Art

An anti-detachable label adhered to a key portion of a print head is often used to prevent the print head from accidental disassembly. However, users who understand the structure of the print head can still disassemble the print head without damaging the anti-detachable label.

Therefore, there is room for improvement in the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the print head. Moreover, in the drawings like reference numerals designate corresponding parts throughout the several views. Wherever possible, the same reference numerals are used throughout the drawings to refer to the same or like elements of an embodiment.

DETAILED DESCRIPTION

Figure 1:
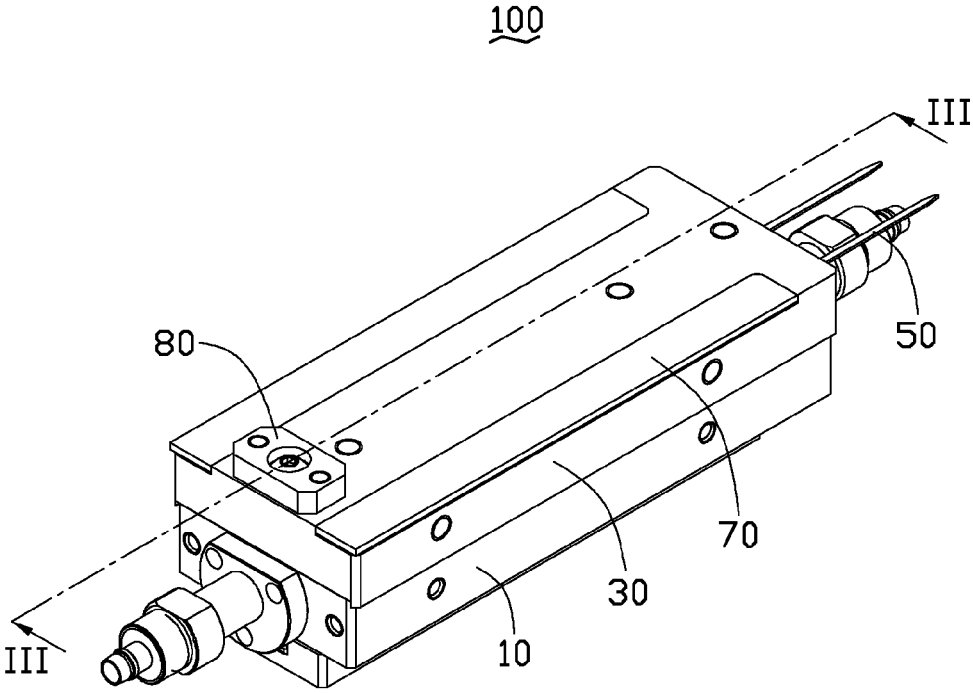
FIG. 1 is a partial, isometric view of a first embodiment of a print head.
Figure 2:
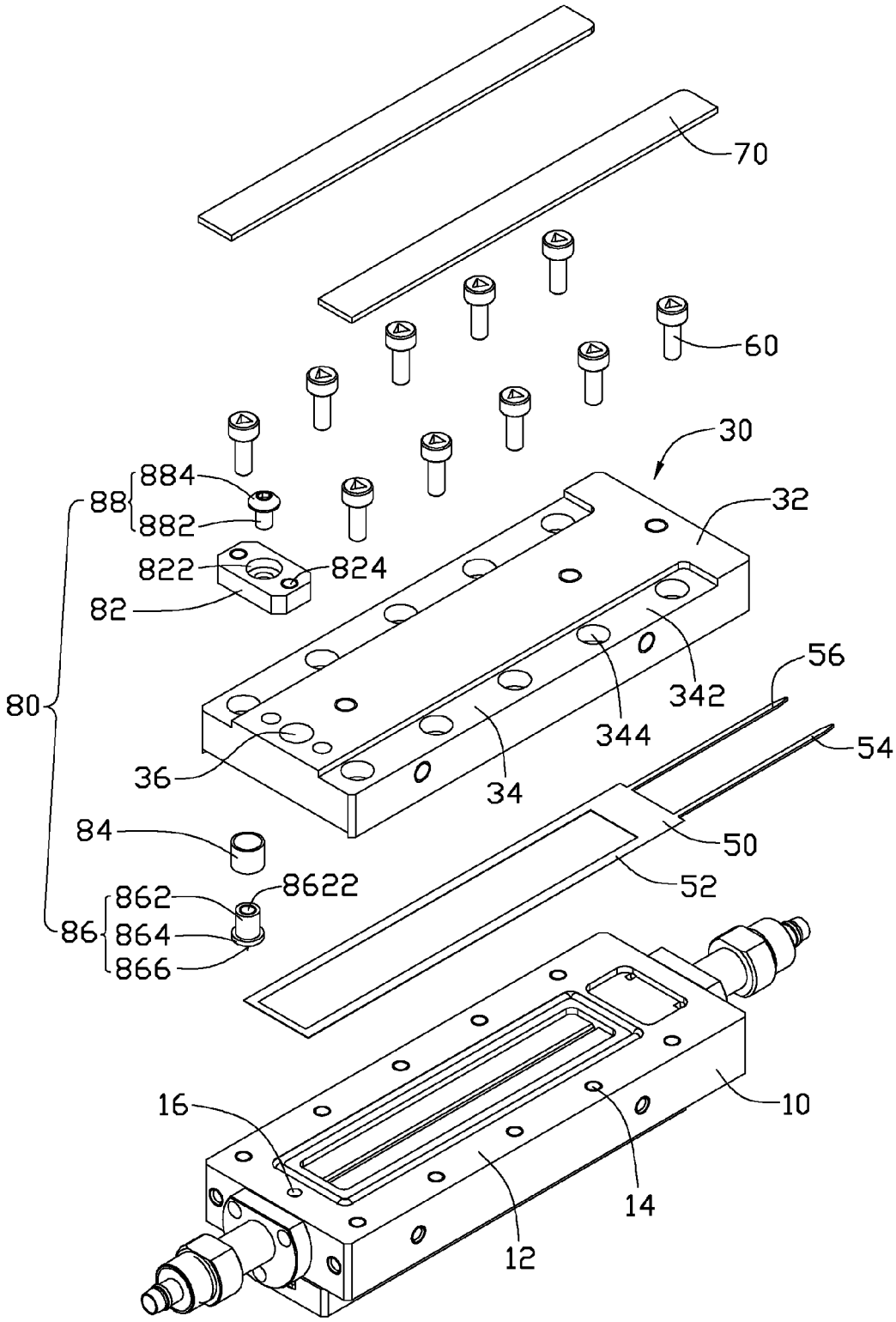
FIG. 2 is an exploded, isometric view of the print head of FIG. 1.

Referring to FIG. 1 and FIG. 2, a first embodiment of a print head 100 includes a nozzle plate 10, a fixing plate 30, an oscillation sheet 50, a plurality of connecting members 60, two shielding members 70, and a security assembly 80. The fixing plate 30 is fixed to the nozzle plate 10 by the connecting members 60. The oscillation sheet 50 is fixed between the nozzle plate 10 and the fixing plate 30. The two shielding members 70 are fixed to the fixing plate 30 to shield the connecting members 60. The security assembly 80 is fixed to an end of the fixing plate 30.

The nozzle plate 10 can be substantially rectangular. The nozzle plate 10 includes a resisting surface 12. The resisting surface 12 defines a plurality of connecting holes 14 spaced apart from each other. The connecting holes 14 are arranged in two imaginary lines adjacent to two opposite edges of the resisting surface 12, respectively. The resisting surface 12 defines an assembling hole 16 in a middle portion of an end of the resisting surface 12.

Figure 3:
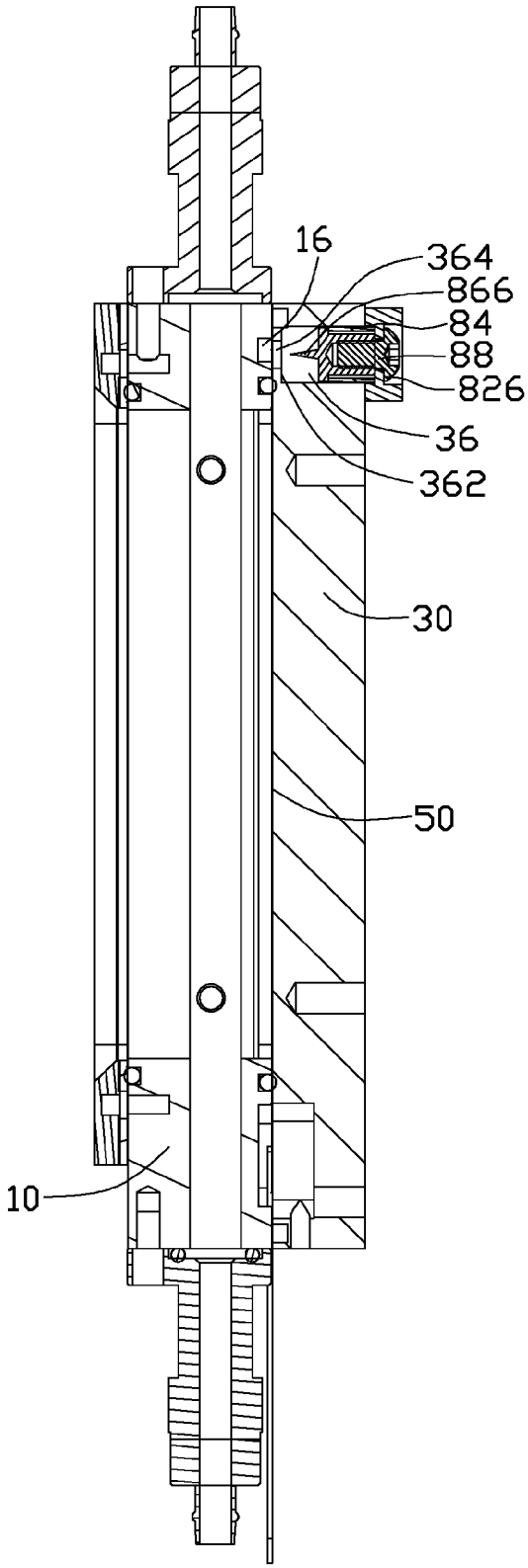
FIG. 3 is a partial, cross-sectional view of the print head of FIG. 1, taken along line III-III.

Referring to FIG. 3, the fixing plate 30 can be substantially rectangular. The fixing plate 30 includes a fixing surface 32, two fixing portions 34 formed at two opposite edges of the fixing surface 32 corresponding to the two opposite edges of the resisting surface 12 having connecting holes 14, and a receiving groove 36 defined in a middle portion of an end of the fixing surface 32 corresponding to the assembling hole 16 of the resisting surface 12. Each of the fixing portions 34 is depressed from the resisting surface, and includes a bottom surface 342. Each of the bottom surfaces 342 defines a plurality of connecting through holes 344 corresponding to the connecting holes 14. The receiving groove 36 can be substantially cylindrical. The receiving groove 36 includes a bottom surface 362 and a through hole 364 defined in the bottom surface 362 corresponding to the assembling hole 16.

The oscillation sheet 50 includes a main body 52 and two electrodes 54 and 56 extending outwardly from an end of the main body 52 substantially parallel to each other. The main body 52 can be a substantially rectangular sheet. The oscillation sheet 50 is fixed between the two lines of the connecting holes 14 of the resisting surface 12. The size of the main body 52 is less than a distance between of the connecting holes 14 at the opposite sides of the resisting surface 12. The main body 52 includes a plastic sheet and an oscillation film covering the plastic sheet. The electrodes 54 and 56 are electrically connected to a drive circuit (not shown) of a printer.

In the illustrated embodiment, the connecting members 60 are screws. The fixing plate 30 is fixed on the nozzle plate 10 by the connecting members 60 extending through the through holes 344 and fixed in the connecting holes 14.

Each of the shielding members 70 can be substantially strip-shaped. Each of the shielding members 70 is received in a corresponding fixing portion 34. A plurality of identification codes (not shown) are printed on the outer surface of the shielding member 70 to prevent the print head 100 from detaching.

In alternative embodiments, the number of the shielding members 70 can be one or more than two to cover the connecting members 60.

The security assembly 80 includes a fixing component 82, an elastic component 84, an anti-detachable component 86, and a fixing element 88. In the illustrated embodiment, the fixing component 82 can be substantially rectangular. The fixing component 82 defines a stepped hole 822 in the middle portion of the fixing component 82. A stepped surface 826 (see FIG. 3) is formed in the stepped hole 822. The fixing component 82 further defines two threaded through holes 824 in two opposite sides of the stepped hole 822 to fix the fixing component 82 to the fixing plate 30. The elastic component 84 can be an elastic hollow cylinder.

The anti-detachable component 86 can be substantially cylindrical. The anti-detachable component 86 includes an assembly portion 862, a resisting portion 864 formed at an end of the assembly portion 862, and a pointed tip 866 extending from a distal end of the resisting portion 864 away from the assembly portion 862. The assembly portion 862 axially defines a threaded hole 8622 in an end of the assembly portion 862 away from the resisting portion 864.

In the illustrated embodiment, the fixing element 88 is a screw. The fixing element 88 includes a screw portion 882 and a screw head 884 formed at an end of the screw portion 882 to allow the fixing element 88 to be rotated. The fixing element 88 threadedly engages with the threaded hole 8622 to hold the anti-detachable component 86 and the fixing component 82 together.

In assembly, the elastic component 84 sleeves on the assembly portion 862, and an end of the anti-detachable component 86 away from the resisting portion 864 is inserted into the stepped hole 822. At this time, the fixing element 88 is inserted into the stepped hole 822 from the other side of the fixing component 82 and threadedly engages with the threaded hole 8622. The elastic component 84 is in an elastically deformed state with an end of the elastic component 84 resisting against the resisting portion 864 and the other end of the elastic component 84 resisting against the stepped surface 826.

In alternative embodiments, the elastic component 84 can be a spring or an elastic sheet with an end of the elastic component 84 resisting against the resisting portion 864 and the other end of the elastic component 84 resisting against the stepped surface 826.

In alternative embodiments, the anti-detachable component 86 includes an assembly portion 862 and a pointed tip 866 extending from a distal end of the assembly portion 862. The assembly portion 862 axially defines a threaded hole 8622 in an end of the assembly portion 862 away from the resisting portion 864. The elastic component 84 resists against an end of the assembly potion 862 away from the pointed tip 866 and the other end of the elastic component 84 resists against the stepped surface 826.

The oscillation sheet 50 is loaded on the middle portion of the resisting surface 12, with the assembling hole 16 covered by the oscillation sheet 50. The electrodes 54 and 56 are electrically connected to the drive circuit. The fixing plate 30 is fixed to the nozzle plate 10 by the connecting members 60 correspondingly threading through the through holes 344 and fixing with the connecting holes 14, with the assembling hole 16 corresponding to the through hole 364. The oscillation sheet 50 is fixed between the fixing plate 30 and the nozzle plate 10. The two shielding members 70 are correspondingly received in the two fixing portions 34 respectively to cover the connecting members 60. In the illustrated embodiment, the two shielding members 70 are adhered to the two fixing portions 34 by an adhesive, such as an epoxy resin adhesive.

The fixing component 82 is fixed on the fixing plate 30 by screws (not shown) and threadedly engages with the threaded through holes 824. In alternative embodiments, the fixing component 82 can be adhered or welded to the fixing plate 30. The anti-detachable component 86 with the elastic component 84 is received in the receiving groove 36, with the pointed tip 866 pointing towards the through hole 364.

When the print head 100 is to be detached, if the user of the print head 100 detaches the print head 100 from the shielding members 70 first, then the identification codes printed on the outer surface of the shielding members 70 are damaged. If the user detaches the fixing element 88 first, then the elastic force of the elastic component 84 is released, and the elastic component 84 will push the anti-detachable component 86 to move towards the oscillation sheet 50 until the resisting portion 864 resists against the bottom surface 362 of the receiving groove 36. At this time, the pointed tip 866 pierces through the oscillation film of the main body 52. As a result, the two electrodes 54 and 56 are short circuited. The print head 100 is thereby safely detached by the disassembly as described above.

Figure 4:
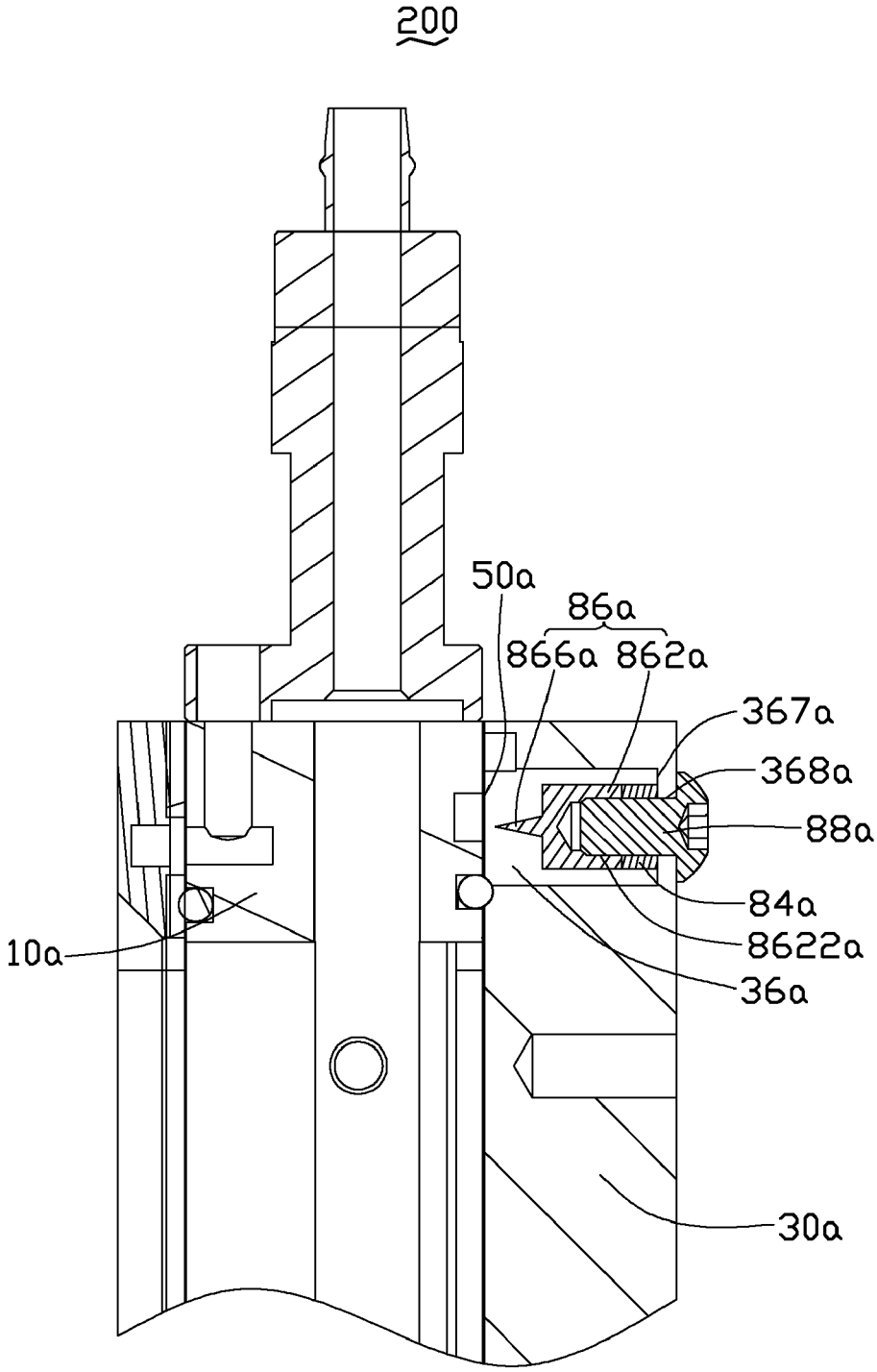
FIG. 4 is a partial, cross-sectional view of a second embodiment of a print head.

Referring to FIG. 4, a second embodiment of an print head 200 is similar to the print head 100, except that a receiving groove 36*a* includes a bottom surface 367*a* away from a nozzle plate 10*a* and a through hole 368*a* defined in the bottom surface 367*a*. An anti-detachable component 86*a* includes an assembly portion 862*a*, a pointed tip 866*a* extending from a distal end of the assembly portion 862*a*, and a threaded hole 8622*a* defined in an end of the assembly portion 862*a* away from the pointed tip 866*a*. An elastic component 84*a* and the anti-detachable component 86*a* are both received in the receiving groove 36*a*, with the pointed tip 866*a* pointed towards an oscillation sheet 50*a*. A fixing element 88*a* extending through the through hole 368*a* threadedly engages with the threaded hole 8622*a* to hold the anti-detachable component 86*a* and a fixing plate 30*a* together. The elastic component 84*a* sleeves on the fixing element 88*a* in a compressed state, with an end of the elastic component 84*a* resisting against the assembly portion 862*a* of the anti-detachable component 86*a* and the other end of the elastic component 84*a* resisting against the bottom surface 367*a*.

When the fixing element 88*a* is detached, the elastic force of the elastic component 84*a* is released, and the elastic component 84*a* pushes the anti-detachable component 86*a* towards the oscillation sheet 50*a* until the pointed tip 866*a* pierces through the oscillation film of the oscillation sheet 50*a*.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A print head, comprising:

a nozzle plate;

a fixing plate fixed to the nozzle plate, the fixing plate comprising a receiving groove defined therein;

an oscillation sheet fixed between the fixing plate and the nozzle plate and covering the receiving groove; and a security assembly comprising a fixing component, an elastic component, a fixing element, an anti-detachable component, and a pointed tip extending from a distal end of the anti-detachable component, wherein the security assembly is fixed to the fixing plate, the elastic component and the anti-detachable component are received in the receiving groove with the pointed tip pointed towards the oscillation sheet, a first end of the elastic component resists against the fixing component and a second end of the elastic component resists against the anti-detachable component.

2. The print head of claim 1, wherein the anti-detachable component further comprises an assembly portion and a resisting portion formed at an end of the assembly portion, and the pointed tip extends axially from a distal end of the resisting portion.

3. The print head of claim 2, wherein the fixing component defines a stepped hole in a middle portion of the fixing component, the assembly portion axially defines a threaded hole at an end of the assembly portion away from the resisting portion, and the fixing element extending through the stepped hole threadedly engages with the threaded hole to hold the anti-detachable component and the fixing component together.

4. The print head of claim 3, wherein a stepped surface is formed in the stepped hole, the first end of the elastic component resists against the stepped surface, and the second end of the elastic component resists against the resisting portion.

5. The print head of claim 1, wherein the anti-detachable component further comprises an assembly portion, and the pointed tip extends axially from a distal end of the assembly portion.

6. The print head of claim 5, wherein the fixing component defines a stepped hole at a middle portion of the fixing component, the assembly portion axially defines a threaded hole at an end of the assembly portion away from the resisting portion, the fixing element extending through the stepped hole threadedly engages with the threaded hole to hold the anti-detachable component and the fixing component together.

7. The print head of claim 6, wherein a stepped surface is formed in the stepped hole, a first end of the elastic component resists against the stepped surface, and a second end of the elastic component resists against an end of the assembly portion away from the pointed tip.

8. The print head of claim 1, wherein the oscillation sheet comprises a main body, two electrodes extending from an end of the main body, and an oscillation film covering the main body, and the two electrodes are electrically connected to a drive circuit.

9. The print head of claim 1, further comprising a plurality of connecting members fixing the fixing plate to the nozzle plate, and at least one shielding member having a plurality of identification codes printed thereon to cover the connecting members.

10. The print head of claim 9, wherein the nozzle plate comprises a resisting surface defining a plurality of connecting holes spaced from each other and arranged at two lines of two opposite edges of the resisting surface corresponding to the connecting members, and an assembling hole corresponding to the receiving groove defined in a center of an end of the resisting surface.

11. The print head of claim 10, wherein the oscillation sheet is fixed between the two lines of the connecting holes of the resisting surface, and the width of the main body is slightly smaller than a distance between the connecting holes at the opposite sides of the resisting surface.

12. A print head, comprising:

a nozzle plate;

a fixing plate fixed to the nozzle plate, the fixing plate comprising a receiving groove defined therein;

an oscillation sheet fixed between the fixing plate and the nozzle plate and covering the receiving groove; and a security assembly comprising an elastic component, a fixing element, and an anti-detachable component comprising a pointed tip, wherein the security assembly is fixed to the fixing plate, the elastic component and the anti-detachable component are received in the receiving groove with the pointed tip pointed towards the oscillation sheet, a first end of the elastic component resists against the fixing plate and a second end of the elastic component resists against a bottom surface of the receiving groove.

13. The print head of claim 12, wherein the anti-detachable component comprises an assembly portion, and the pointed tip extends axially from a distal end of the resisting portion.

14. The print head of claim 13, wherein the assembly portion axially defines a threaded hole at an end of the assembly portion away from the pointed tip, the bottom surface of the receiving groove defines a through hole, and the fixing element extending through the through hole threadedly engages with the threaded hole to hold the anti-detachable component and the fixing component together.

15. The print head of claim 14, wherein the first end of the elastic component resists against the bottom surface of the receiving groove and the second end of the elastic component resists against an end of assembly portion away from the pointed tip.

16. The print head of claim 12, wherein the oscillation sheet comprises a main body, two electrodes extending from an end of the main body, and an oscillation film covering the main body, and the two electrodes are electrically connected to a drive circuit.

17. The print head of claim 12, further comprising a plurality of connecting members fixing the fixing plate to the nozzle plate, and at least one shielding member having a plurality of identification codes printed thereon to cover the connecting members.

18. The print head of claim 17, wherein the nozzle plate comprises a resisting surface defining a plurality of connecting holes spaced from each other and arranged at two lines of two opposite edges of the resisting surface corresponding to the connecting members, and an assembling hole corresponding to the receiving groove defined in a center of an end of the resisting surface.

19. The print head of claim 18, wherein the oscillation sheet is fixed between the two lines of the connecting holes of the resisting surface, and the width of the main body is slightly smaller than a distance between the connecting holes at the opposite sides of the resisting surface.

* * * * *